US005996679A

United States Patent [19]

Pinnow et al.

[11] Patent Number: 5,996,679

[45] Date of Patent: Dec. 7, 1999

[54] APPARATUS FOR SEMI-SOLID PROCESSING OF A METAL

[75] Inventors: Kenneth E. Pinnow, Pittsburgh, Pa.; Raymond F. Decker, Ann Arbor, Mich.

[73] Assignee: Thixomat, Inc., Ann Arbor, Mich.

[21] Appl. No.: 08/743,335

[22] Filed: Nov. 4, 1996

[51] Int. Cl.[6] ..... B22D 17/02

[52] U.S. Cl. ..... 164/312

[58] Field of Search ..... 75/246, 243, 244; 419/11, 29, 49, 45; 164/312

[56] References Cited

U.S. PATENT DOCUMENTS

| | | | |
|---|---|---|---|
| 1,057,423 | 4/1913 | Haynes . | |
| 1,057,828 | 4/1913 | Haynes . | |
| 3,966,422 | 6/1976 | Kelley . | |
| 4,123,266 | 10/1978 | Foley et al. | 75/244 |
| 4,694,881 | 9/1987 | Busk | 164/113 |
| 4,694,882 | 9/1987 | Busk | 164/113 |
| 5,040,589 | 8/1991 | Bradley et al. | 164/113 |
| 5,242,758 | 9/1993 | Hitchcock et al. | 428/547 |

OTHER PUBLICATIONS

M. Schmidt et al Die Verminderung des Kobaltgehaltes in Aufschweiblegierungen Jan. 1941, pp. 357–362.

Cobalt in Hardfacing and Wear Resistant Alloys, Brussels 1960—p. 377.

J.M. Drapier et al. P/M Versus Cast Wear–Resisting Cobalt–Base Alloys—1974—pp. 62–68.

Hanes Wrought Wear–Resistant Alloys—Cabot Corporation—1976—p. 6.

K.C. Antony—Wear Resistant Cpbalt–Base Alloys, Feb. 1983—pp. 52–60.

E. Bayer et l.—Die heibisotatische Prebtechnik (HIP)—Aug. 1983—pp. 779–784.

K. Kulkarni—Full Density PM Parts of Stellite Alloys—MPR, Dec. 1983—pp. 681–684.

H. Berns et al—Microstructure and Properties of CoCr29W (Stellite 6)—Sep./Oct. 1985—pp. 292–305.

J. Stamberger et al—Comparison Between Hot Isostatic Pressing and Rotary Forging—Jun. 1987—pp. 217–223.

H. Kohmoto et al—Fabrication Technologies and Properties of P/M Superalloys, Ti Alloys—1988—pp. 641–646.

W. Kortmann—Comparison Conventional Hot Work Tool Steels With Ni an Co–Based Alloys Sep. 1989 pp. 87–108.

R.J. Dawson et al—Appendix: P/M Cobalt–Base Wear–Resistant Materials—1990—pp. 977–980.

P. Cook—Cobalt and Cobalt–Alloys—1990—pp. 446–454.

W. Graf et al—The Production and Processing of High–Quality Powder Metallurgy Materials—1991 pp. 246–251.

J. Auger et al—Design and Manufacture of Engineered Components Clad by HIP—Jun. 1991—pp. 229–234.

E. Bayer et al—HIP–Werkstoffechnik in der Kunststoffverarbeitung—pp. 1–5.

M.A. Ashworth et al—HIP Diffusion Bonding for Gear Materials—May 1996—pp. 275–280.

D.H. Kirkwood—Semisolid Metal Processing—International Materials Review—1994.

E. Bayer et al—HIP–Werkstoffechnik in der Kunststoffverabeitung—Jan. 1991.

*Primary Examiner*—Ngoclan Mai

*Attorney, Agent, or Firm*—Harness, Dickey & Pierce, P.L.C.

[57] ABSTRACT

A fully dense powder metal cobalt-base article having high resistance to semi-solid metal wear and corrosion. The article has a constituent composition of C in an amount of about 0.65 to less than about 1%, W in an amount of about 3 to about 5%, Cr in an amount of about 25 to about 30%, Co in an amount principally comprising the balance of the article. The article has a hardness of greater than 42HRC and more preferably 45HRC, a bend fracture strength of greater than 330 ksi and substantial dimensional and mechanical property stability during exposure to temperatures in range of about 1100° F. to 1500° F.

15 Claims, 9 Drawing Sheets

| Material | C | Mn | P | S | Si | Ni | Cr | W | Mo | Fe | Co | N |
|---|---|---|---|---|---|---|---|---|---|---|---|---|
| PM Alloy 0.8C | 0.80 | 0.79 | 0.004 | 0.002 | 0.38 | 2.15 | 27.81 | 4.11 | - | 1.18 | Bal | 0.066 |
| PM Alloy 6 | 1.11 | 0.53 | - | - | 0.77 | 0.13 | 28.34 | 4.60 | - | 1.40 | Bal | - |
| PM Alloy 12 | 1.41 | 0.40 | <0.005 | 0.002 | 0.84 | 1.57 | 28.90 | 8.68 | 0.27 | 1.42 | Bal | 0.052 |
| Cast Alloy 12 | 1.31 | 0.48 | - | - | 0.37 | 2.80 | 28.79 | 8.23 | 0.28 | 3.26 | Bal | - |

FIG. 2

PM Stellite 12
As-HIP
(1.41% C)

PM Stellite 6
As-HIP
(1.11% C)

PM Alloy 0.8C
As-HIP
(0.80% C)

400x

1000x

| Material | Condition | Heat Treatment | 70°F | 1000°F | 1150°F | 1200°F | 1250°F | 1400°F | 70°F[b] |
|---|---|---|---|---|---|---|---|---|---|
| Stellite 6B[c] | Rolled Plate | Annealed at 2250°F | 36.0 HRC | 226 HB (20.5 HRC) | - | 203 HB (11.5 HRC) | - | 167 HB | - |
| Stellite 6[d] | Sand Cast | - | 45.0 HRC | 275 DPH (26.6 HRC) | - | 260 DPH (24.2 HRC) | - | 185 DPH | - |
| PM Alloy 0.8C | As-HIPed | - | 42.2 HRC | - | - | - | - | - | - |
| PM Alloy 0.8C | As-HIPed | Annealed at 2190°F | 44.6 HRC | - | - | - | - | - | - |
| PM Alloy 6 | As-HIPed | - | 46.0 HRC | - | - | - | - | - | - |
| PM Alloy 6 | As-HIPed | Annealed at 2190°F | 45.0 HRC | - | - | - | - | - | - |
| Stellite 12[d] | Sand Cast | - | 46.0 HRC | 325 DPH (33.0 HRC) | - | 285 DPH (27.6 HRC) | - | 245 DPH (21.6 HRC) | - |
| PM Alloy 12 | As-HIPed Sleeve | - | 76.1 HRA (50.5 HRC) | - | 69.1 HRA (37..5HRC) | - | 66.6 HRA (32.6 HRC) | - | 76.2 HRA (50.5 HRC) |
| PM Alloy 12 | As-HIPed Clad | - | 76.5 HRA (51.5 HRC) | - | 67.1 HRA (33.5 HRC) | - | 64.3 HRA (28.0 HRC) | - | 76.0 HRA (50.0 HRC) |
| PM Alloy 12 | As-HIPed Clad | Double Aged | 77.0 HRA (52.5 HRC) | - | 68.0 HRA (35.0 HRC) | - | 68.1 HRA (35.0 HRC) | - | 77.2 HRA 52.5 HRC |
| Alloy 718 | As-HIPed Composite | - | 69.6 HRA (39.0 HRC) | - | 63.8 HRA (27.0 HRC) | - | 65.9 HRA (31.0 HRC) | - | 70.2 HRA (40.0 HRC) |
| Alloy 718 | As-HIPed Composite | Double Aged | 72.5 HRA (44.0 HRC) | - | 68.1 HRA (35.5 HRC) | - | 67.4 HRA (34.0 HRC) | - | 72.4 HRA (44.0 HRC) |
| H-13 Tool Steel[e] | - | Quenched and Tempered | 46.5 HRC | 33.0 HRC | - | 17.0 HRC | - | - | - |
| H-19 Tool Steel[e] | - | Quenched and Tempered | 47.5 HRC | 35.0 HRC | - | 19.0 HRC | - | - | - |

a - Converted HRC values given in parentheses
b - Hardness at 70°F after being heated and tested at 1150°F or 1250°F and then cooled back to room temperature
c - Haynes wrought wear resistant Alloys, Cabot Stellite Division
d - Thermadyne Stellite coatings
e - Crucible CPM 9V data sheet, 1987

FIG. 5

| Material | Condition | Test Temperature | 0.02% Yield Strength psi | 0.2% Yield Strength Strength psi | Tensile Strength psi | Percent Elongation | Hardness HRC |
|---|---|---|---|---|---|---|---|
| PM Alloy 12 | As-HIPed | RT | 72,199 | 127,075 | 199,816 | <1 | 50.6 |
| | | 1200°F | 75,086 | 100,249 | 150,493 | 3.5 | 51.2 [a] |
| | | | | | | | |
| PM Alloy 12 | As-HIPed + 1325°F/8 hr/FC to 1150°F/1150°F/8 hr/AC | RT | 61,132 | 128,599 | 197,550 | <1 | 50.7 |
| | | 1200°F | 73,302 | 97,101 | 151,716 | 3.8 | 51.3 [a] |
| | | | | | | | |
| Stellite 6[b] | Sand Cast | RT | - | 78,500 | 130,00 | 1.0 | 40 |
| | | | | | | | |
| Stellite 12[b] | Sand Cast | RT | - | 94,100 | 135,500 | <1 | 48 |

a - Hardness at room temperature after testing
b- Cobalt and Cobalt Alloys, Metals Handbook, Volume 2, 10'th Edition, pp. 446-454

FIG. 6

| Material | Condition | Initial Hardness HRC | Aging Temperature (°F) | Hardness After Aging for the Indicated Times (HRC)[a] | | | | | | |
|---|---|---|---|---|---|---|---|---|---|---|
| | | | | 4 hours | 8 hours | 14 hours | 24 hours | 72 hours | 100 hours | 200 hours |
| PM Alloy 0.8C (0.80%C) | As-HIPed | 42.0 | 1200 | - | - | - | - | 48.0 | - | - |
| | | | 1400 | - | - | - | - | - | - | - |
| | Annealed 2190°F | 44.5 | 1200 | - | - | - | - | 45.0 | - | - |
| | | | 1400 | - | - | - | - | - | - | - |
| PM Alloy 6 (1.11%C) | As HIPed | 44.0 | 1200 | 43.5 | 45.5 | 47.5 | 51.0 | 51.0 | 50.0 | 50.0 |
| | | | 1400 | 48.5 | 49.5 | 49.0 | 49.0 | 49.5 | 49.0 | 49.0 |
| | Annealed 2190°F | 45.0 | 1200 | - | - | - | - | 45.5 | - | - |
| | | | 1400 | - | - | - | - | - | - | - |
| Stellite 12 Centrifugally Cast (1.31%C) | As-Cast | 44.5 | 1200 | 44.5 | 44.5 | 46.5 | 45.5 | 46.0 | - | - |
| | | | 1400 | 45.0 | 44.0 | 44.5 | 45.0 | 44.5 | - | - |
| | Annealed 2190°F | | 1200 | - | - | - | - | - | - | - |
| | | | 1400 | - | - | - | - | - | - | - |
| PM Alloy 12 (1.41%C) | As HIPed | 51.5 | 1200 | 51.5 | 51.0 | 52.0 | 52.0 | 55.0 | 54.0 | 55.0 |
| | | | 1400 | 51.0 | 51.0 | 51.0 | 51.5 | 52.0 | 51.5 | 53.0 |
| | Annealed 2190°F | 48.5 | 1200 | - | - | - | - | 49.5 | - | - |
| | | | 1400 | - | - | - | - | - | - | - |

a - Hardness measured at room temperature after the specimen was heated for the indicated times at 1200 or 1400°F

FIG. 7

| Method of Measurement | Original Length (Inches) | 1200F/48 Hr Length (Inches) | Change Length (Inches) | Original Diameter (Inches) | 1200F/48 Hr Diameter (Inches) | Change Diameter (Inches) |
|---|---|---|---|---|---|---|
| Cordax | 4.00035 | 3.99800 | -0.00235 | 0.3763 | 0.3762 | -0.0001 |
| Vernier Calipers | 4.00025 | 3.99800 | -0.00225 | 0.3760 | 0.3760 | - |

a - Initial hardness - 51 HRC. Hardness after heating for 48 hours at 1200° F - 53 HRC.

FIG. 8

| Material | Condition | Hardness HRC | Bend Fracture Strength (ksi) | Deflection at Fracture (In.) |
|---|---|---|---|---|
| PM Alloy 0.8C (0.80%C) | As-HIP | 42.2 | 358 | 0.135 |
| | | 42.2 | 335 | 0.108 |
| | HIP+1200F/72 hours | 47.8 | 401 | 0.109 |
| | | | 376 | 0.083 |
| | 2190°F/2 hours | 44.6 | 397 | 0.198 |
| | | | 386 | 0.188 |
| | 2190°F+1200°F/72 hours | 45.2 | 388 | 0.172 |
| | | | 367 | 0.135 |
| PM Alloy 6 (1.11%C) | As-HIP | 46.0 | 326 | 0.085 |
| | HIP+Double Age [a] | 50.5 | 386 | 0.085 |
| | HIP+1200°F/72 hours | 52.0 | 403 | 0.077 |
| | 2190°F/2 hours | 45.0 | 385 | 0.145 |
| | 2190°F+1200°F/72 hours | 45.5 | 367 | 0.102 |
| PM Alloy 12 (1.41%C) | As-HIP | 52.0 | 319 | 0.040 |
| | HIP+Double Age [a] | 52.5 | 325 | 0.039 |
| | HIP+1200°F/72 hours | 55.0 | 358 | 0.046 |
| | 2190°F/2 hours | 48.5 | 344 | 0.055 |
| | 2190+1200°F/72 hours | 49.5 | 357 | 0.051 |
| Centrifugally-Cast Alloy 12 (1.31% C) | As-Cast | 45.0 | 203 | 0.024 |
| | Cast+Double Aged [a] | 46.0 | 196 | 0.024 |
| | Cast+1200°F/72 hours | 46.0 | 203 | 0.027 |

a - Alloy 718 double age - 1400°F/10 hours, furnace cool to 1200°F and hold for 10 hours, air cool to room temperature

FIG. 9

APPARATUS FOR SEMI-SOLID PROCESSING OF A METAL

BACKGROUND AND SUMMARY OF THE INVENTION

The present invention relates to cobalt-base articles having high resistance to wear and corrosion in semi-solid metal environments. More specifically, the invention relates to fully dense powder metallurgy articles, made from a novel Co—Cr—W—C type alloy being particularly suited for long term use in high wear, high temperature machinery employing a variant process of semi-solid metal molding (SSM).

The metallurgical process referred to herein is one where metals and metal matrix composites are heated and stirred in the solid plus liquid phase region and then injected into a mold or die at lower temperatures. This process has proven to result in parts having improved material characteristics, previously uncastable and unobtainable shapes, and reduced post formation processing steps. Two versions of the above process, also known as Thixomolding® (Thixomat, Inc., Ann Arbor, Mich.), are generally disclosed in U.S. Pat. Nos. 4,694,881 and 4,694,882, which are herein incorporated by reference. The process generally involves the shearing of a semi-solid metal so as to inhibit the growth of dendritic solids and to produce nondendritic solids within a slurry having improved molding characteristics which result in part from its thixotropic properties (a semi-solid nondendritic material which exhibits a viscosity which is proportional to the applied shear rate and lower than that of the same alloy when in a dendritic state).

A machine adapted to employ the above type of processes and to which the present invention has particular applicability is schematically shown in FIG. 1. The construction of the molding machine 10 is, in some respects, similar to that of a plastic injection molding machine. In the illustrated machine 10, feed stock is fed via a hopper 12 into a heated, reciprocating screw injection system 14 which maintains the feedstock under a protective atmosphere 16, such as argon. As the feed stock is moved forward by the rotating motion of a screw 18, it is heated by heaters 20 and stirred and sheared by the action of the screw 18. This heating and shearing is done to bring the feedstock material into its solid plus liquid temperature range. The thixotropic slurry formed by this action passes through a nonreturn valve 22 in the forward part of the injection system 14 of the machine 10 into an accumulation chamber 24. Upon accumulation of the needed amount of slurry in the accumulation chamber 24, the injection cycle is initiated by advancing the screw 18 with a hydraulic actuator and causing the mold 26 to fill through a nozzle 28. As opposed to other methods of semi-solid molding, the above described method has the advantage of combining slurry generation and mold filling into a single step. It also minimizes the safety hazards involved in melting and casting reactive semi-solid metals. Obviously, and as will be further appreciated, the component construction of the present invention will find applicability as articles, not only in the construction of machines 10 practicing the above method, but also in machines practicing alternative variations on the above process and other processes. Such machines and articles include, without limitation, die casting, metal injection molding, plastic injection molding machines as well as tools and dies.

Because of contact with corrosive semi-solid metals (such as magnesium and zinc), the elevated operating temperatures, oxidation, and the high wear nature of the environment (contact between the various operating parts of the machine and the semi-solid metal is an extremely high wear and shock condition), components of the above machinery are very demanding on their materials of construction. Screw velocities, for example, involve acceleration from 0 to 3 meters/sec. and deceleration back down to 0, all in 0.2 seconds. The chosen materials of construction must be resistant to corrosive attack by the semi-solid metal being processed, must be highly resistant to wear, and must exhibit sufficient strength and toughness to withstand the stresses imposed during long-term exposure at the relevant elevated temperatures under these severe thermal cycling and high shock conditions.

From a corrosion standpoint, iron and some cobalt-based alloys have been reported as satisfactory for processing semi-solid magnesium-base alloys. Nickel-base alloys, such as Alloy 718, are of interest as construction materials because of their good strength at elevated temperatures and lower cost when compared to most cobalt-base alloys. However, because molten magnesium attacks nickel containing alloys, some SSM processors have specified that alloys which come into contact with molten magnesium must contain less than about three percent nickel. Prior machines avoided this problem by using Alloy 718 in their barrel constructions while incorporating a shrink-fitted barrel insert made of a cobalt-base alloy such as Stellite 6 (nominally 28 Cr, 4.5W and 1.2C) or Stellite 12 (nominally 30Cr, 8.3W and 1.4C), which are commercially available from the Cabot Corporation, Kokomo, Ind. While generally performing well with respect to corrosion, they are deficient in toughness and have exhibited cracking and fracture in the machines of the above type. Under the high temperature fatigue conditions of the machines, cracks in Stellite liners have been seen to propagate into the Alloy 718 barrel resulting in total failure of the barrel assembly. This is unsafe and necessitates costly repairs and replacements. It has come to be determined that articles of an alternative material, having greater toughness, would be more desirable in that they would provide for longer wearing components.

The selection of materials for processing semi-solid aluminum-base alloys is much more complex. This is particularly true because most iron, cobalt, and nickel-base alloys are readily attacked by aluminum alloys. In addition to these concerns and those recited in connection with processing magnesium, other important concerns relate to the availability, cost and manufacturing characteristics of the construction material.

In the injection molding of magnesium-base alloys, the maximum operating temperatures within the barrel typically range between about 1100 and 1200° F. with the temperatures sometimes ranging to 1500° F. Most common AISI iron-base hot work tool steels (such as H-10 and H-13, and even more highly alloyed hot work tool steels such as H-19 and H-21) lose strength, hardness and wear resistance at these temperatures. As a result, a number of very specialized materials for machine construction have been used, in particular these alloys include Stellite 6 and 12 (mentioned above) and similar Co—Cr—W—C-type alloys. These alloys have been used to form centrifugally-cast barrel liners or weld overlays. The use of Co—Cr—W—C-type barrel liners avoids the corrosion problems that can be encountered between molten magnesium and nickel-base alloys. Their use as liners therefore permits the use of the more cost effective nickel-base alloys, such as Alloy 718, for barrel construction. Special maraging-type hot work tool steels, such as Thyssen 1.2888 (nominally 0.2C, 10Cr, 2Mo, 5.5W, and 10.00Co) have been used in screws and nonreturn valves. Thyssen 1.2888 reportedly can be used for short times at temperatures as high as 1292° F. (700° C.).

Because of problems related to cost and availability, as well as in an attempt to upgrade performance, the present inventors began a search for a new alloy to replace the currently used Co—Cr—W—C-type alloys and Thyssen 1.2888. This search has lead to Alloy 718 barrels HIP-clad with a new, powder metallurgy (PM) cobalt-base wear resistant alloy, as well as to the construction of various monolithic parts made of the same alloy. The properties of the present components made from PM cobalt-base wear resistant alloys, produced by nitrogen atomization and hot isostatic pressing (HIP), differ considerably from the previously seen Co—Cr—W—C-type alloys (produced from powder by conventional press and sintering methods). The new alloys exhibit an improved combination of strength, toughness, and dimensional stability and it has been found beneficial to also modify their heat treatment.

The traditional Co—Cr—W—C-type alloys are quaternary cobalt-base alloys containing about 27–29% chromium, a variable amount of tungsten (4 to 17%) and carbon (0.9–3.2%). They are widely used in wear resistant applications because of their high strength, corrosion resistance, and ability to retain their hardness at elevated temperatures. Because of their limited hot workability and machinability, however, most of the higher carbon Co—Cr—W—C-type alloys are used in the form of castings, hard facing consumables and powder metallurgy parts.

Considerable work has been done to explore the production of atomized powder metallurgy (PM) Co—Cr—W—C-type alloys by hot isostatic pressing (HIPing) of gas atomized prealloyed powders. In general, prior studies have shown that PM processing of these materials produces a material with higher hardness, higher tensile strength, and higher ductility than is achieved by casting the alloys and that these improvements are still retained at elevated temperature. The abrasive wear resistance of these PM materials is somewhat lower than their cast counterparts owing to the smaller sizes of the primary carbides. For the same reasons, their machinability has been seen to improve.

With regard to the properties of the prior Co—Cr—W—C-type alloys, it has often been assumed that these alloys are at their maximum hardness in the cast or welded condition and that their properties cannot be changed by subsequent heat treatment. Similarly, it has also been assumed that putting these alloys in service at elevated temperature has little effect on their hardness, toughness, and dimensional stability. Contrary to this assumption, some of the published literature for weld deposits, wrought alloys and PM alloys indicate that many of the Co—Cr—W—C-type alloys exhibit an increase in hardness due to carbide precipitation when heated in the range of 1200 to 1500° F. When aged at these temperatures, articles of the Co—Cr—W—C-type alloys might therefore be subject to a change in size, strength and toughness and this is not acceptable in all applications. The operating temperatures during single step, metal injection molding (as generally described above) approach those at which carbide precipitation may occur in PM Co—Cr—W—C-type alloys. Much of the work done and resulting in the present invention was based on concerns about the possible effects that high temperature exposure might have on the mechanical properties and dimensional stability of PM Co—Cr—W—C-type alloys. This research was also conducted to determine what, if any, changes in the alloy composition or subsequent heat treatment could be employed to minimize the above effects on the resulting articles.

In view of the above and other limitations of the prior art, it is a principle object of the present invention to provide fully dense articles made from a novel PM Co—Cr—W—C-type alloy which are highly resistant to changes in size, hardness, corrosion resistance, strength and toughness as a result of prolonged exposure to temperatures in the range of about 1200° F. to 1500° F.

Another object is to provide a fully dense PM cobalt-base article which is resistant to corrosion in semi-solid magnesium and zinc.

It is also an object of the present invention to provide fully dense PM cobalt-base articles which exhibits adequate hardness without a decrease in toughness.

A still further object of this invention is to provide fully dense PM cobalt base articles exhibiting increased toughness over prior art articles and alloys thereby resulting in components of longer life and increased safety.

Additional benefits and advantages of the present invention will become apparent to those skilled in the art to which the present invention relates from the subsequent description of the preferred embodiment and the appended claims, taken in conjunction with the accompanying drawings.

BRIEF DESCRIPTION OF THE DRAWINGS

FIG. 2 is a table of the chemical compositions of some of the PM alloys principally investigated, including the alloy of the present invention, as well as a cast alloy of the same general variety;

FIG. 5 is a comparative hardness table for some of the alloys investigated in the discovery of the present invention;

FIG. 6 is a table of the tensile properties of PM Alloy 12 which was investigated in the discovery of the present invention;

FIG. 7 is a table of the aging response of some PM alloys and one cast alloy investigated in the discovery of the present invention;

FIG. 8 is a table of the dimensional stability of PM Alloy 12 when heat treated for a period of forty-eight hours; and FIG. 9 is a table of the bend fracture properties of the PM alloys and cast alloy presented in FIG. 7.

DETAILED DESCRIPTION OF THE PREFERRED EMBODIMENT

Figure 1:
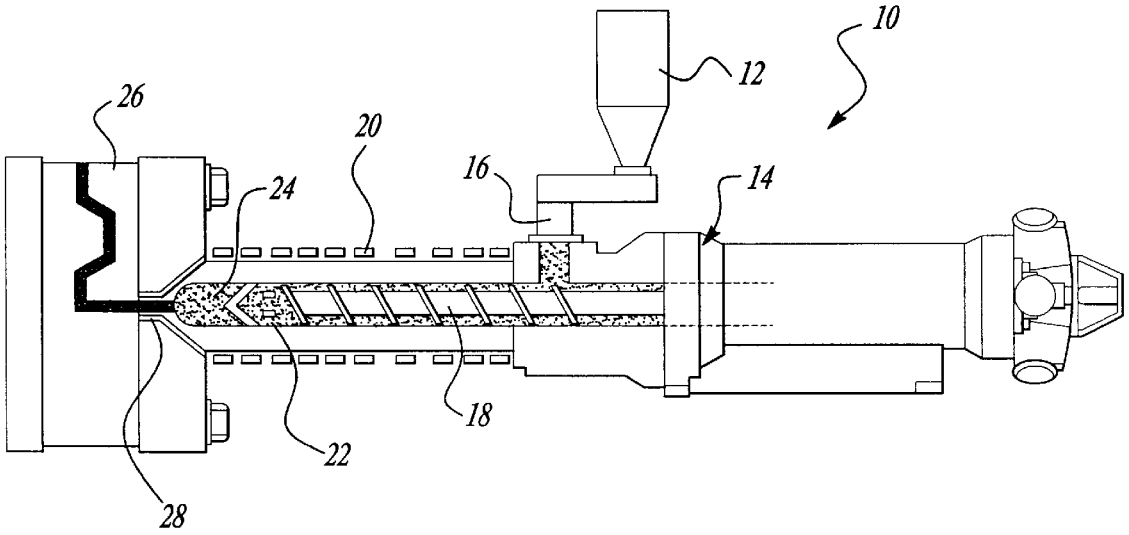
FIG. 1 is a schematic illustration of a machine to which the present invention will have particular applicability.
Figure 3A:
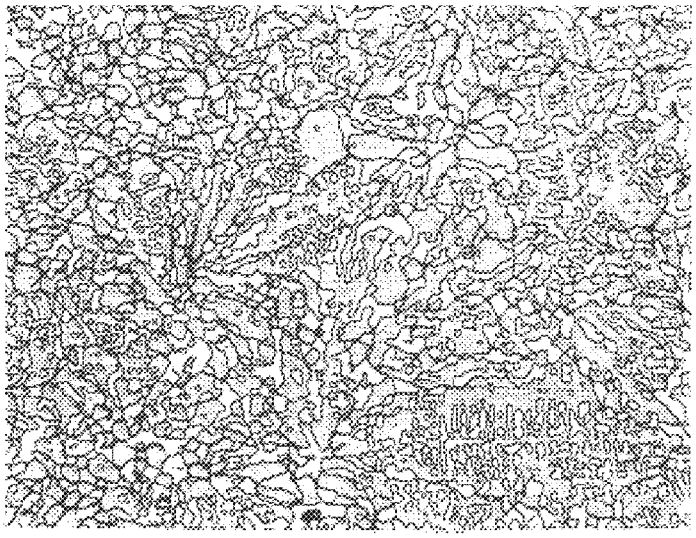
FIGS. 3*a*–3*c* are micrographs (1000× magnification; ammonium persulfate as etchant) of the PM alloys presented in the table of FIG. 1.
Figure 3B:
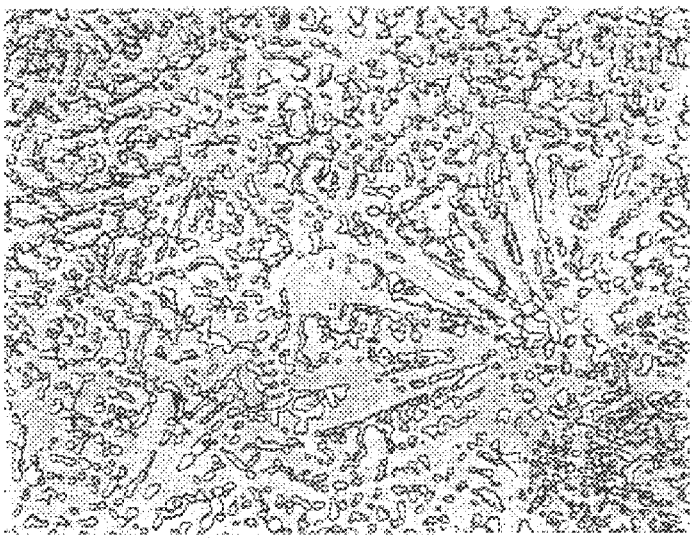
Figure 3C:
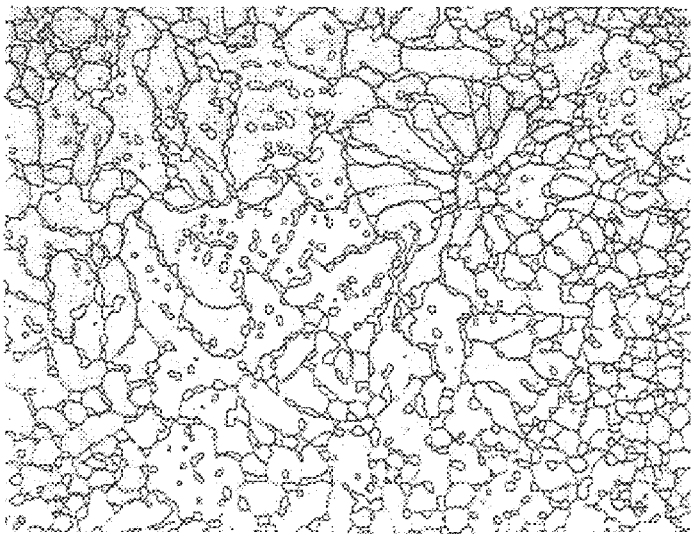
Figure 4A:
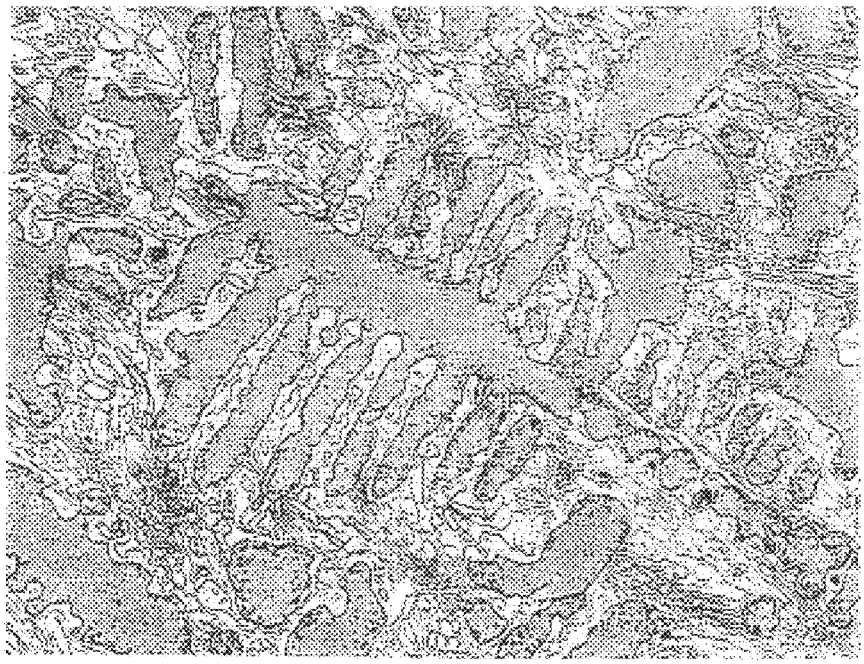
FIGS. 4*a* and 4*b* are micrographs (400× and 1000× magnification, respectively; ammonium persulfate as etchant) of the cast alloy 12 presented in the table of FIG. 1.
Figure 4B:
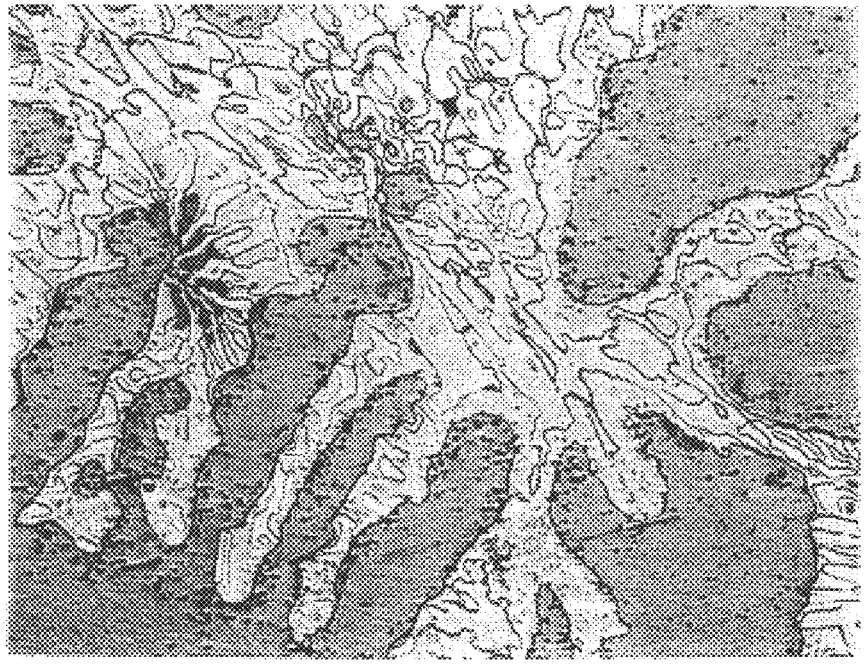

The chemical compositions of some of the Co—Cr—W—C-type alloys evaluated in this investigation as potential construction materials for the machine 10 (seen in FIG. 1) are given in FIG. 2. Included in the table are three PM Co—Cr—W—C-type alloys and one centrifugally cast Cr—Co—W—C-type alloy. The compositions of the PM Alloys 6 and 12 are similar to those commonly used for cast Co—Cr—W—C-type alloys, in particular Stellite 6 and Stellite 12 respectively. The cast alloy 12 sample was taken from a Stellite 12 centrifugally cast barrel liner commercially produced for a machine 10 of the above variety and which failed, cracked, in service. As seen in FIG. 1, the nominal composition of PM Alloy 0.8C was 0.80C, 27.81Cr and 4.11W and the balance principally Co with 0.066N; for PM Alloy 6 these constituents were 1.11C, 29.34Cr and 4.60W and the balance principally Co; for PM Alloy 12 these constituents were 1.41C, 28.90Cr, 8.68W and the balance principally Co; and for Cast Alloy 12 these constituents were 1.31C, 28.79Cr, 8.23W and the balance principally Co. The nickel content in each of the above was respectively 2.15, 0.13, 1.57 and 2.80. Numerous samples for further analysis were created by HIPing the PM materials. As further discussed below, PM Alloy 0.8C was intentionally melted to a lower than normal carbon and tungsten content. The powders of PM alloy 0.8C were prepared not by common argon atomization techniques, but by nitrogen atomization. The nitrogen dissolving into the resulting alloy during this process appears to increase its strength and aging response. By using nitrogen atomization for producing the alloy, thermal induced porosity, which is often encountered in argon atomized alloys, was found to be substantially non-existent.

FIGS. 3*a*–3*c* and 4*a* and 4*b*, show the microstructures of the Co—Cr—W—C-type alloys of FIG. 2. As seen in those figures, the PM Co—Cr—W—C-type alloys in the as-HIPed condition contain a fairly random dispersion of small carbides, the amount and size of which increase with the carbon content of the alloy. The primary carbides in the centrifugally cast Co—Cr—W—C-type alloy have the dendritic distribution expected of cast material. Accordingly, these latter carbides are very much larger than those in the PM Co—Cr—W—C-type alloys, and in particular with respect to PM Alloy 12 which has a similar composition. As a result of the larger carbides, it is anticipated and borne out by testing that the material would be less tough than the others.

Hardness measurements for various alloys at various temperatures are presented in the table of FIG. 5. This data was obtained in some instances from published literature provided by the commercial supplier of the material. In those instances the supplier is footnoted in the table. Regarding the sources for the data on those samples, Stellite® 6B (Haynes Wrought Wear-Resistant Alloys, 1976, Cabot Corporation Stellite Division, Kokomo, Ind.); sand cast Stellite® 6 and 12 (Thermadyne Stellite Coatings, Goshen, Ind.); and H-13 Tool Steel and H-19 Tool Steel (Crucible CPM, 9V data sheet, 1987, Crucible Materials Corporation, Pittsburgh, Pa.). Of the three PM Alloy 12 samples, one was from a sleeve or insert for a composite barrel construction as described above in connection with machine 10. The other two samples were taken from a test ring made by HIP-cladding PM Alloy 12 to a hollow cylinder made of conventional Alloy 718. Because most HIP-clad barrels of Alloy 718 will probably be aged after HIP-cladding, one of these latter samples was given the standard double age hardening treatment for Alloy 718 (1325° F./8 hr/FC to 1150° F./8 hr/AC) before it was tested. The other HIP-clad sample was tested in the as-HIPed condition. For PM Alloy 0.8C, one sample was tested as HIPed and one sample as annealed at 2190° F. prior to testing.

Allowing for some scatter in the data, it is clear the hot hardness of PM Alloy 12 is greater than that of the wrought alloy, Stellite 6B, cast Stellite 6 and sand cast Stellite 12, at both room and at elevated temperatures. The results also indicate that a double aging heat treatment increased the hardness of Alloy 718 over the non-aged sample at both room and elevated temperatures. The same also appears to be true to, but to a lesser extent, for the double aged sample of PM Alloy 12. As expected, the hot hardness of all the Co—Cr—W—C-type materials, except possibly for the wrought alloy of Stellite 6B, are significantly higher than those of the listed two conventional hot work tool steels.

In that PM Alloy 12 showed a hardness increase when double aged, an investigation into its tensile properties was conducted. The results of these investigations are summarized in the table of FIG. 6 where data for Stellite 6 and 12 are presented for comparison. The results show that the tensile strength levels of PM Alloy 12 (as HIPed) are quite high both at room and elevated temperature. Both proved to be higher than that reported in the literature for sand cast Stellite 6 and Stellite 12 at room temperature. The heat treating of PM Alloy 12 using a standard Alloy 718 double aging treatment did not significantly change the tensile properties at either room temperature or 1200° F.

The long term structural stability of the PM Co—Cr—W—C-type alloys when used at elevated temperatures was investigated by measuring the room temperature hardness of specimens after the specimens had been heated for various lengths of time at 1200 to 1400° F. These results are presented in the table of FIG. 7. Size change measurements on a cylindrical sample of as-HIPed PM Alloy 12, which had been heated in a vacuum for 48 hours at 1200° F., are presented in the table of FIG. 8.

Referring to FIG. 7, all three PM Co—Cr—W—C-type alloys in the as-HIPed condition exhibited significant hardening after being heated to 1200 or 1400° F. and aged. The magnitude of the hardness increase produced after aging at 1200° F. for 72 hours varied with a given alloy with the low carbon PM Alloy 0.8C increasing 6HRC, PM Alloy 6 increasing 7HRC and PM Alloy 12 increasing 3.5HRC. Surprisingly, the low carbon PM Alloy 0.8C increased in hardness to 48HRC, well above the preferred hardness of 42HRC and the more preferred hardness of 45HRC for the intended application in the machine 10 described above. However, the maximum hardness achieved after the aging treatment at 1200° F. increased generally in relation to the carbon content of the PM alloys with PM Alloy 12 exhibiting the highest hardness value after seventy-two hours. Solution annealing the PM Co—Cr—W—C-type alloys at 2190° F. for two hours prior to aging at 1200° F. appeared to reduce aging response, both in terms of the magnitude of the hardness increase and the maximum hardness achieved. These hardnesses, however, were still at acceptable levels. Regarding aging of the as-cast sample of Stellite 12 at 1200° F. for 72 hours, only a small change in hardness of about 1.5HRC was produced.

The size change data in FIG. 8 indicates that as-HIPed PM Alloy 12 shrinks slightly (0.0001 inches) after being heated at 1200° F. for 48 hours. No size change measurements have been made on specimens of PM Alloy 12 heated for longer times at 1200° F. As further discussed below, in at least one instance of actual use, severe shrinkage occurred in a PM Alloy 12 barrel liner. The cause of that shrinkage has not yet been identified.

With the PM alloys all exhibiting good hardness, the bend fracture strength or toughness, another critical property for the intended application, of the PM Co—Cr—W—C-type alloys and of centrifugally cast Stellite 12 were respectively determined for specimens in the as-HIPed or as-cast conditions and in a variety of aged or heat treated conditions. The specimens were tested using a standard three point bend test fixture and during the tests, the deflection of the specimens was recorded at 400 pound load intervals and at the time of fracture. The table of FIG. 9 gives the bend fracture strength and the deflection at the time of fracture for each of the test specimens (two specimens each for PM Alloy 0.8C).

For the PM Alloy 0.8C and PM Alloy 6, which have similar base compositions other than their carbon contents, the average as-HIPed results indicate that lowering the carbon content from 1.11 to 0.80% produces a notable increase in bend ductility. Solution annealing these two alloys at 2190° F. also improved the bend ductility of these materials both with and without aging at 1200° F. Solution annealing the PM Alloy 12 material at 2190° F. for 2 hours also sightly improved the bend ductility of PM Alloy 12, both with and without aging at 1200° F. The results for the specimens of as-cast Alloy 12 indicate that the bend fracture strength and bend ductility of this material is significantly lower than those of the PM Alloy 12, which is of similar composition. The large differences in the bend ductility of these two materials most probably relates to the pronounced differences in the amount, size and distribution of the primary carbides, as previously illustrated in FIGS. 3 and 4.

The results of the above tests generally indicate that PM Co—Cr—W—C-type alloys produce materials with higher hardness, higher tensile strength, and greater ductility than is achieved by casting alloys of the same composition. They also show that the PM alloys in the as-HIPed condition exhibit an increase in hardness with only a very small change in dimensions (for PM Alloy 12) when aged at temperatures between 1200 and 1400° F. Solution annealing at 2190° F. of the as-HIPed materials appears to reduce, but does not entirely eliminate, the aging response of these PM alloys when heated at these temperatures.

From the test results, it has also been seen that, surprisingly, both the toughness and ductility of the PM Co—Cr—W—C-type alloys can be significantly improved by lowering their carbon contents below the levels customarily used for Stellite 6 and 12 or PM Alloys 6 and 12 while still retaining high hardness values, values in excess of 42HRC. These carbon contents below 1.0% are preferred and more preferably below 0.88%. Lower carbon contents, below 0.65%, are expected to be too soft and not capable of resisting wear at the 1200° F. operating temperature. It is believed that, because of the finer grain structure, fine carbide size and uniform carbide distribution which is obtained in articles of the present lower carbon PM Co—Cr—W—C-type alloy, articles out of the present alloy exhibits higher toughness and strength than cast or PM Co—Cr—W—C-type alloys of higher carbon content. The same benefit of fine grain size will be seen in high temperature fatigue resistance of liner and barrel components as well as other articles. As seen in FIG. 9, the toughness of the low carbon PM alloy, when solution annealed and aged, exhibited a three fold increase over similarly treated PM Alloy 12 and a 30% increase over similarly treated PM Alloy 6 while providing substantially the same hardness. For this reason, it is concluded that articles of the lower carbon Co—Cr—W—C-type alloys, such as PM Alloy 0.8C, provide significant advantages as high stress components (such as nozzles, adapter rings, sliding rings, non-return valves and other monolithic parts as well as barrel liners and lined barrels) in SSM machines 10. It is also believed that this lower carbon content, and at least down to 0.65C, for the PM Co—Cr—W—C-type alloys would further reduce any dimensional changes in articles resulting from service at the relevant elevated temperatures.

The aging response and mechanical properties of the PM Co—Cr—W—C-type alloys are dependent on composition, particularly carbon content, and on heat treatment. For these reasons PM Co—Cr—W—C-type alloys in general are good candidates for SSM machine 10 construction. In particular, the PM low carbon modification, containing 0.65%–0.88% carbon, is believed to be the best candidate for the SSM machine 10 components as a result of its significantly enhanced toughness as well as good wear (hardness) and oxidation resistance at elevated temperatures.

To further substantiate the conclusions presented above, tests were conducted on various components for various ones of the above materials. The components included barrel liners, nozzles, piston rings and sliding rings.

Regarding tests on barrel liners, a cast alloy 12 liner put into service in a 400 ton Thixomolder® was found to have cracked after only 100 hours of service in processing semi-solid magnesium. Another cast alloy 12 liner in a 400 ton Thixomolder® was found to have chipped at the seal area during seal maintenance after 320 hours of service. Another barrel liner exhibited a crack in the cast alloy 12 liner after nine cycles (one hour) of service in a 400 ton magnesium processing unit. Suddenly, after 200,000 cycles, this crack propagated into the Alloy 718 barrel to a length of eighteen inches, resulting in failure of the barrel and leakage of high pressure magnesium. While the size change data of FIG. 8 indicates minor shrinkage for PM Alloy 12, severe shrinkage occurred in a PM alloy 12 liner for a 400 ton unit during the first hours of service, opening up to a 0.015" gap at the seal and resulting in dangerous magnesium blow-by. The cause of this shrinkage has not yet been determined. While extensive service time on a PM alloy 0.8C liner has yet to be fully completed, it is noted that fabrication of a new barrel for a 600 ton unit proceeded without incident and without shrinkage.

In testing nozzles, it was noted that standard alloy steel (e.g. DIN 1.2885 and 1.2888) nozzles have oxidized rapidly and softened to <10Rc. One alloy steel nozzle lost ⅛" from its surface after only 500 hours of service in processing magnesium. This softening also led to bending of the nozzle. A PM alloy 0.8C nozzle was found not to have oxidized or softened in service. Its thermal properties were found to be better than alloy steel in that it held temperature better and thereby eased temperature control at the nozzle.

Regarding piston and sliding rings, PM alloy 6 piston rings were put into service and were found to have fractured from low toughness. This occurred both during mounting and after only 200 shots in 4 hours. PM alloy 0.8C piston rings have lasted 25,000 shots, without failure. A PM alloy 6 sliding ring failed in 75 shots under the high shock conditions seen by these parts. PM alloy 0.8C sliding rings have been fabricated and, based on the above results, service life is expected to be 60,000 shots or more. Alloy steel piston and sliding rings were further found to have softened, leading to high wear, in a few hours in processing semi-solid magnesium. This opened up a very significant bypass of slurry through the non-return valve. This, in turn, decreased the effectiveness of the high pressure and velocity of the forward shot and led to poor filling of the parts and to abnormal porosity in the parts.

While the above description constitutes the preferred embodiment of the present invention, it will be appreciated that the invention is susceptible to modification, variation and change without departing from the proper scope and fair meaning of the accompanying claims.

We claim:

1. An apparatus for semi-solid processing of a metal, comprising:

an injection system having a barrel for receiving the metal therein, heaters to heat the metal into a liquid plus solid phase at a temperature in the range of 600° F. to 1500° F., shearing means for shearing the metal in said injection system to inhibit the formation of dendrites in the liquid plus solid phase of the metal, transporting means for moving the semi-solid metal through said injection system, and a nozzle, said transporting means also for injecting the liquid plus solid metal through said nozzle and into a mold to form a molded article;

wherein at least one component of said injection system contacts the metal being processed therein, said component being at least partially formed from a fully dense powder metal Co—Cr—W—C-type material, said material having a constituent composition of C in an amount of about 0.65 to about 0.88%, W in an amount of about 3 to about 5%, Cr in an amount of about 27 to about 30%, and Co in an amount principally comprising a balance of said composition, and said material having a hardness of greater than 42HRC, a bend fracture strength of greater than 330 ksi, and substantial dimensional and mechanical property stability during exposure to temperatures in the range of about 1100° F. to about 1500° F.

2. An apparatus as set forth in claim 1 wherein said C is in an amount of about 0.8%.

3. An apparatus as set forth in claim 1 wherein said W is in an amount of about 4%.

4. An apparatus as set forth in claim 1 wherein said Cr is in an amount of about 27 to about 28%.

5. An apparatus as set forth in claim 1 wherein said Cr is in an amount of about 27.8%.

6. An apparatus as set forth in claim 1 wherein said component is a heat treated component.

7. An apparatus as set forth in claim 6 wherein said component has been formed by process steps including the step of annealing at a temperature greater than 2000° F.

8. An apparatus as set forth in claim 6 wherein said component has been formed by the process steps including the step of aging at a temperature of at least 1100° F. for 72 hours.

9. An apparatus as set forth in claim 1 wherein said component is said nozzle.

10. An apparatus as set forth in claim 1 wherein said component is said barrel.

11. An apparatus as set forth in claim 1 wherein said barrel includes a liner and said component is said liner.

12. An apparatus as set forth in claim 1 wherein said transporting means includes a piston ring and said component is said piston ring.

13. An apparatus as set forth in claim 1 wherein said component has a hardness of greater than 44HRC.

14. An apparatus as set forth in claim 1 wherein said component has a hardness of greater than 45HRC.

15. An apparatus as set forth in claim 1 wherein said transporting means includes an extruder screw and said extruder screw is said component.

* * * * *